US010553050B1

(12) United States Patent
Romero

(10) Patent No.: US 10,553,050 B1
(45) Date of Patent: Feb. 4, 2020

(54) SYSTEM TO REGISTER USERS TO PRE-AUTHORIZE THEM TO ENTER PRESELECT LOCATIONS

(71) Applicant: One Step Shot, LLC, Miami, FL (US)

(72) Inventor: Carlos Romero, Miami, FL (US)

( * ) Notice: Subject to any disclaimer, the term of this patent is extended or adjusted under 35 U.S.C. 154(b) by 0 days.

(21) Appl. No.: 16/222,436

(22) Filed: Dec. 17, 2018

(51) Int. Cl.
*G07C 9/00* (2006.01)

(52) U.S. Cl.
CPC ..... *G07C 9/00111* (2013.01); *G07C 9/00896* (2013.01)

(58) Field of Classification Search
None
See application file for complete search history.

(56) References Cited

U.S. PATENT DOCUMENTS 9,396,598 B2 7/2016 Daniel-Wayman et al.

*Primary Examiner* — Thomas S McCormack
(74) *Attorney, Agent, or Firm* — Sanchelima & Associates, P.A.; Christian Sanchelima; Jesus Sanchelima

(57) ABSTRACT

A system to preauthorize visitors prior to entering a given area private community such as a residential community that records the visitors contact information and hours and frequency of admissions approved by a community's resident. Upon the resident's approval, the guest using their mobile application will communicate with a second mobile phone within the gate's motor assembly. Upon the second mobile phone authenticating the guest based on the parameters set by the host, the second mobile phone through a USB connection sends instructions to an adapter within the motor assembly that opens the barrier.

15 Claims, 2 Drawing Sheets

SYSTEM TO REGISTER USERS TO PRE-AUTHORIZE THEM TO ENTER PRESELECT LOCATIONS

BACKGROUND OF THE INVENTION

Field of the Invention

The present invention relates to a system to allow authorized user to quickly enter a predetermined area and, more particularly, to allow visitors to be preapproved to enter a residential community without the need to stop at a guard gate and be authorized.

Description of the Related Art

Several designs for systems to allow users to enter communities have been designed in the past. None of them, however, include a system that uses an adapter connected to a mobile phone within a motor housing for a gate to preauthorize guests, including taxi services, vendors, contractors, employees or any person that not reside in the complex without requiring them to stop at a guard gate to be authorized. The mobile phone within the motor housing is in communication with a guest's mobile phone registered with the system's server when they come within certain range to each other.

Applicant believes that a related reference corresponds to U.S. Pat. No. 9,396,598 issued to The Chamberlain Group, Inc. However, it differs from the present invention because it does not allow a user to use a bar code generated Bluetooth Low Energy (BLE) Communication by an application on a mobile device to cooperate with a gate scanner device with Bluetooth to allow a preauthorized visitor to enter a given area private community without requiring speaking with someone or stopping.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a system that significantly alleviates traffic congestion at the entrances of private communities.

It is another object of this invention to provide a system that allows guests and/or service providers to be preauthorized before arriving at the area they are attempting to enter.

It is still another object of the present invention to provide a system that allows the mobile device of the guest to communicate via Bluetooth with a mobile device housed within the motor housing that is connected through an adapter to the motor that opens the barrier. Having a mobile phone within the motor housing provides the novel benefit of allowing companies to easily update their security systems and identify issues at each location using a mobile phone's conventional features.

It is yet another object of this invention to provide such a system that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTIONS OF THE DRAWINGS

Figure 1:
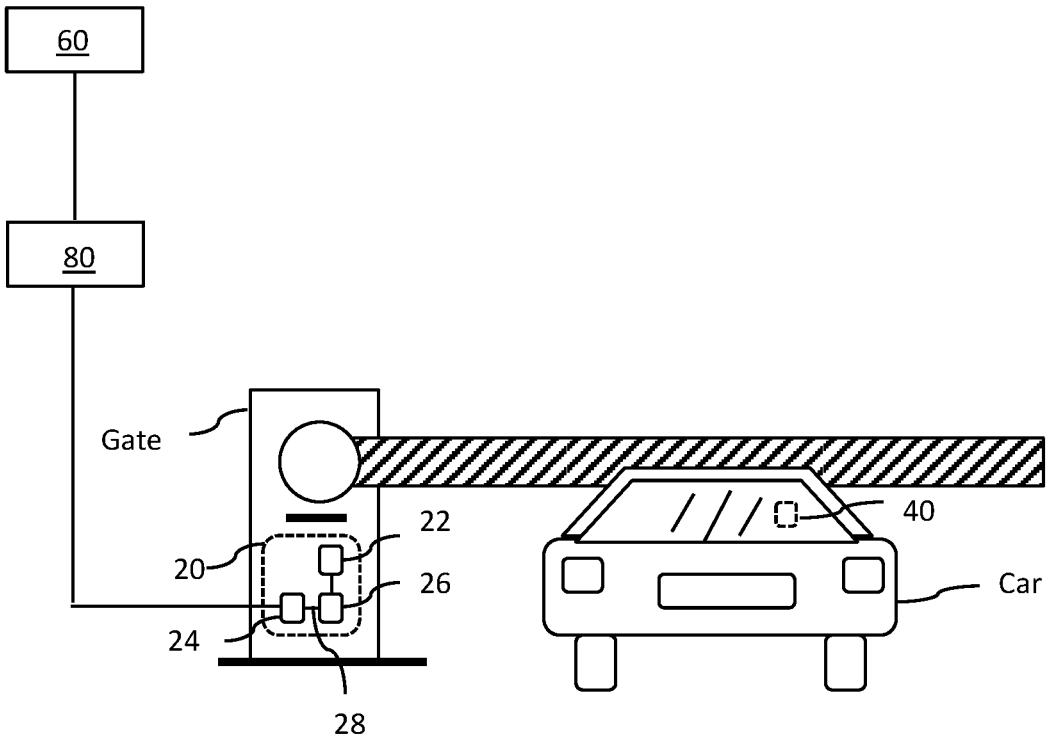

FIG. 1 represents a global schematic of the system subject of the invention showing a guest in a vehicle approaching a community guard gate having second mobile phone 40 in its hand. The second mobile device 40 can be seen communicating with first mobile phone 24 housed within the motor housing f motor assembly 20. Adapter 26 can be seen connected to motor 22 that is in turn connected to the gate barrier. Host computerized device 60 and server 80 can also be seen connected to the devices in the system.

Figure 2:
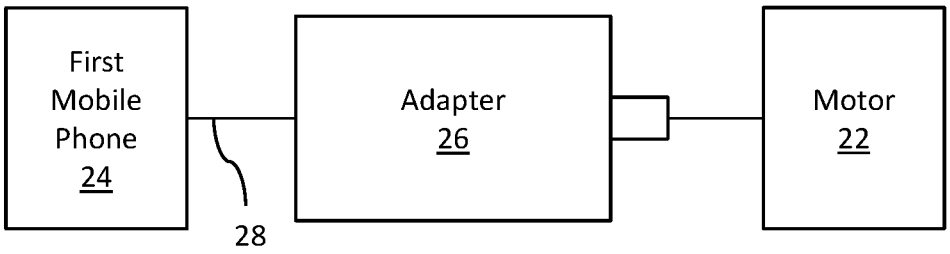

FIG. 2 shows adapter 26 connected using a wired connection to motor 22 and also using USB connection 28 to connect to first mobile phone 24.

Figure 3:
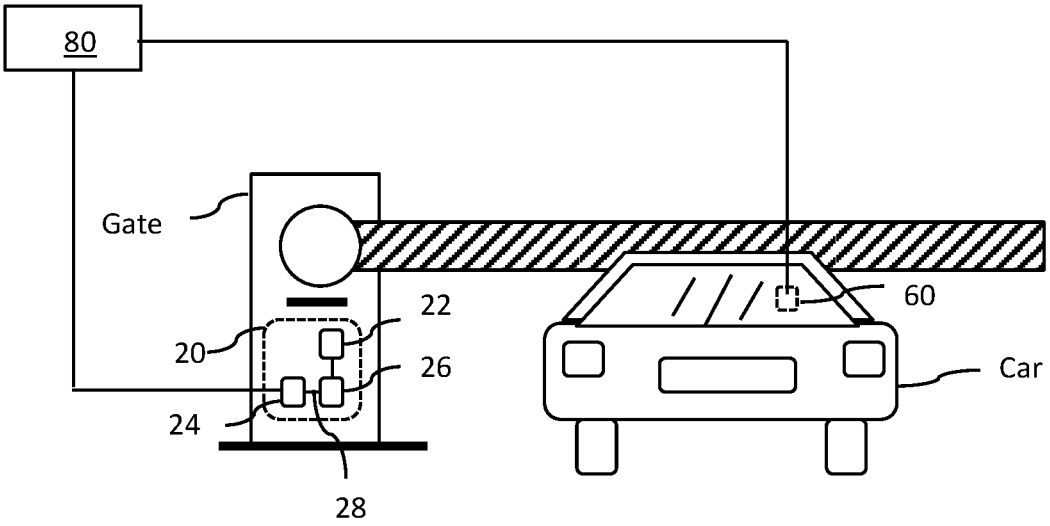

FIG. 3 is a similar illustration as FIG. 1 except now a host computerized device 60 can request and be granted access to its own community.

DETAILED DESCRIPTION OF THE EMBODIMENTS OF THE INVENTION

The present invention basically includes a motor assembly 20, a second mobile device 40 used by a guest or service provider attempting to enter a facility or gated community, a host computerized device 60 and a server assembly 80 configured to include contact information from the registered users using the second mobile device 40 and the host computerized device 60. The motor assembly 20 includes a motor 22 and a first mobile phone 24 housed within said motor assembly 20. The first mobile phone 24 is connected to an adapter 26 using a USB connection 28. Adapter 26 is connected to motor 22 using serial port or similar port that include a wired connection to send instructions to motor 22 to open a barrier such as a boom barrier or a gate upon first mobile device 24 authenticating a guest. The authentication process is done through server assembly 80 that stores the access parameters set by a host using host computerized device 60. These parameters can include the time a guest is allowed to enter or a range of times, and how many times a guest can access the area during a given set of days, hours, or the like. They can also include license plate numbers registered on a guests' mobile device 40. If a guest enters the range in which a signal is detected from second mobile phone 40 by first mobile phone 24 a notification can be sent to the host to see the face of the guest and manually authorize entry. Alternatively, the host can automatically grant access upon guest entering during a prescribed time and the signal emitted by second mobile phone 40 including the access code that can be generated by server assembly 80. The access code can be an email address assigned to each registered guest. Upon the email address or similar access code being received by first mobile device 24 an inquiry will be sent to server assembly 80 to determine whether that email address has the parameters that match allowing access into the facility or community at that moment. If access is granted first mobile device 24 will transmit a signal to adapter 26 to instruct it to open motor 22.

These parameters mentioned above can be generated automatically per company or host or entered manually by the hosts. The guest can also request certain parameters for host approval. In one embodiment, the system works by allowing the guest to request a visit through second mobile phone 40. Guest registration can include the guest's details mentioned above such as license plate, time requested for visit, date, contact information, purpose of visit, etc.

The hosts can accept the visit through his or her own host computerized device 60. The host can then further set the time or adjust the time selected by the guest, or otherwise approve the time proposed or suggest modified parameters. The system then through server 80 records the information inputted by the host and records the host's authorization of the visit.

The system can also coordinate with ride-sharing services such as Lyft or Uber to allow hosts to approve them if they are carrying their guests or themselves, the hosts. This bypasses the need of having a line form at guard gate, boom barrier, or similar barriers booths when hosts or their guests are attempting to access the communities and are being driven by a taxi or ride-sharing service.

With implementation of this system accessing a predetermined facility or community or similar areas will be greatly facilitated. The traffic congestion that forms at these areas will be significantly reduced and the host will have more safety with respect to who is entering their neighborhoods.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A security device to open barriers, comprising:

a barrier, a motor housing having a motor therein adapted to open and close said barrier, an adapter entirely housed within said motor housing having a USB port, a first mobile phone connected to said adapter through said USB port using a USB cable, a second mobile phone operated by a guest, a host computerized device operated by a host, a server connected to said first mobile phone, said second mobile phone, and said host computerized device, said server includes contact information and access authorization parameters for said guest, said second mobile device emits a signal received by said first mobile device, said first mobile device confirms said guest's credentials and upon authorizing the credentials said first mobile phone sends a signal to said adapter to open said barrier.

2. The security device to open barriers of claim 1 wherein said signal is Bluetooth.

3. The security device to open barriers of claim 1 wherein said authorization parameters are set by said host computerized device.

4. The security device to open barriers of claim 1 wherein said adapter includes a processor that receives said signal from said first mobile.

5. The security device to open barriers of claim 1 wherein said parameters include preferred hours in which the guest is allowed into a facility, contact information for the guest attempting to enter the facility, license plate information, timestamps of when the guest entered and exited the facility, number of times the guest is allowed into the facility on a defined day or within a defined time range.

6. The security device to open barriers of claim 1 wherein the parameters are generated automatically based on a type of service provided by the guest or entered manually by said host.

7. The security device to open barriers of claim 1 wherein the host computerized device is configured to receive a notification when the guest is at a predetermined distance from the facility.

8. The security device to open barriers of claim 1 wherein said signal that said first mobile phone receives from said second mobile phone is near field communication, cellular data, Wi-Fi, or optic reading.

9. The security device to open barriers of claim 1 wherein said signal transmitted between adapter and said motor is through a wired connection.

10. The security device to open barriers of claim 9 wherein said signal transmitted to said motor is 5 volts.

11. The security device to open barriers of claim 1 wherein said host computerized device is configured to send a signal to said first mobile device requesting access to said facility or community.

12. The security device to open barriers of claim 11 wherein said signal is Bluetooth, near field communication, RFID, cellular data, or Wi-Fi.

13. The security device to open barriers of claim 1 wherein said adapter includes a voltage input.

14. The security device to open barriers of claim 1 wherein said adapter includes a serial port that connects said adapter to said motor.

15. The security device to open barriers of claim 14 wherein said serial port is connected to said motor through a bridge member.

* * * * *